United States Patent [19]

Morishige et al.

[11] 4,421,419

[45] Dec. 20, 1983

[54] ELECTRONIC TIMEPIECE

[75] Inventors: Morio Morishige, Hachioji; Hironao Sone, Kodaira, both of Japan

[73] Assignee: Casio Computer Co., Ltd., Tokyo, Japan

[21] Appl. No.: 486,452

[22] Filed: Apr. 21, 1983

Related U.S. Application Data

[63] Continuation of Ser. No. 202,861, Oct. 31, 1980, abandoned.

[30] Foreign Application Priority Data

Nov. 12, 1979 [JP] Japan ..... 54-145365

[51] Int. Cl.[3] ..... G04B 23/02; G04C 17/02

[52] U.S. Cl. ..... 368/73; 368/240; 368/261

[58] Field of Search ..... 368/72–74, 368/240, 250–251, 261

[56] References Cited

U.S. PATENT DOCUMENTS

| | | | |
|---|---|---|---|
| 4,007,583 | 2/1977 | Johnson | 368/240 X |
| 4,060,973 | 12/1977 | Martino | 368/261 X |
| 4,104,865 | 8/1978 | Sasaki | 368/261 X |
| 4,106,281 | 8/1978 | Freeman | 368/240 |
| 4,209,974 | 7/1980 | Noble | 368/240 X |
| 4,257,115 | 3/1981 | Hatuse et al. | 368/251 X |
| 4,267,589 | 5/1981 | Yamaguchi | 368/251 X |
| 4,276,541 | 6/1981 | Inoue et al. | 368/251 X |

*Primary Examiner*—Vit W. Miska

*Attorney, Agent, or Firm*—Frishauf, Holtz, Goodman & Woodward

[57] ABSTRACT

In an electronic timepiece, which has a time display section constructed such that optical display elements are selectively driven for time display, the display mode of the time display section can be controlled to provide dynamic displays other than an ordinary time display mode, and in addition to an ordinary time display mode.

14 Claims, 9 Drawing Figures

ELECTRONIC TIMEPIECE

This application is a continuation, of application Ser. No. 202,861, filed Oct. 31, 1980, now abandoned.

BACKGROUND OF THE INVENTION

This invention relates to electronic timepieces for optically displaying time data with liquid crystal, electroluminescent elements, etc.

Commercially available electronic timepieces for displaying time data include those, in which data is optically displayed as numerical values, and those, in which data is optically displayed as a pointer display (analog). In either of these types of timepieces, however, the display is very monotonous because it is changed once for every second only in a second unit display section, with the change in minute and hour unit display sections taking place respectively once for every minute and for every hour. In order to make up for the monotonousness of the display, it has been contemplated to provide a color display, for instance making use of a guest host effect. This display, however, involves difficulties in control, so that it has not yet been put in practice.

The object of this invention is to provide an electronic timepiece which optically displays time data and which can also produce a dynamic display separately from the time display.

SUMMARY OF THE INVENTION

To achieve the above objective, the electronic timepiece according to the invention comprises a timepiece means for producing time data signals by dividing reference clock signal, a display means having a plurality of optical display elements, time data being displayed in said display means according to a time data signal produced from said timepiece means, a timing signal generating means for producing a plurality of cyclic timing signals, a display mode switching command signal generating means for generating a display mode switching command signal, and a display control means for causing dynamic pattern displays based upon the afore-said plurality of cyclic timing signals to be produced on said display means in lieu of the time display based upon said time data signal in response to a display mode switching command signal from said display mode switching command signal, generating means.

With the construction according to the invention, in which a plurality of optical display elements constituting a time display section are selectively driven to display time data, all the optical display elements are adapted to be driven within a predetermined period of time, so that it is possible to produce dynamic pattern displays and make up for monotonousness of display. Also, the timepiece may be used as an ornamental device as well as a timepiece.

This invention can be more fully understood from the following detailed description when taken in conjunction with the accompanying drawings.

DETAILED DESCRIPTION

Figure 1A:
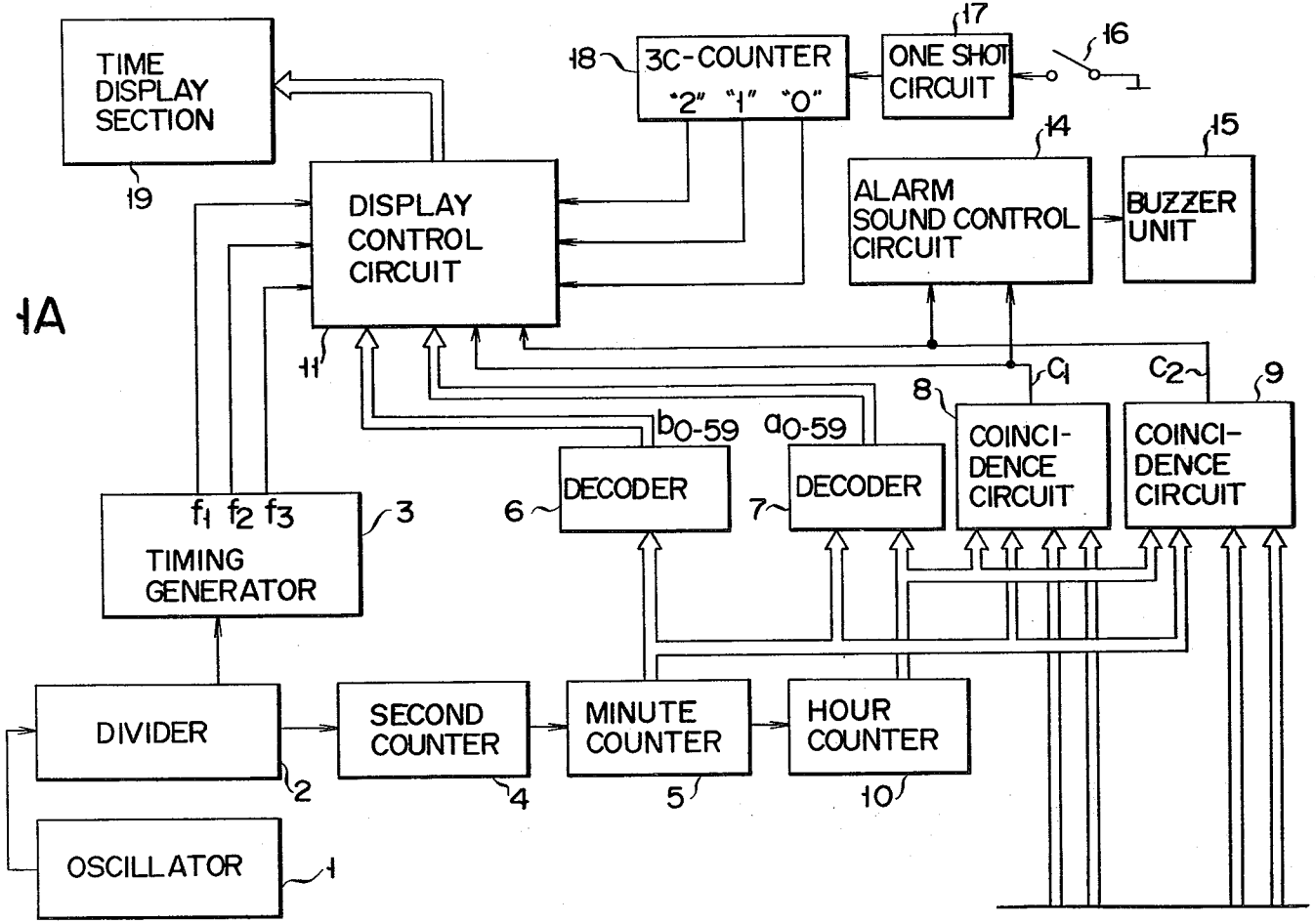
FIGS. 1A and 1B show a clock diagram of the circuit of an electronic timepiece with an alarm function.
Figure 1B:
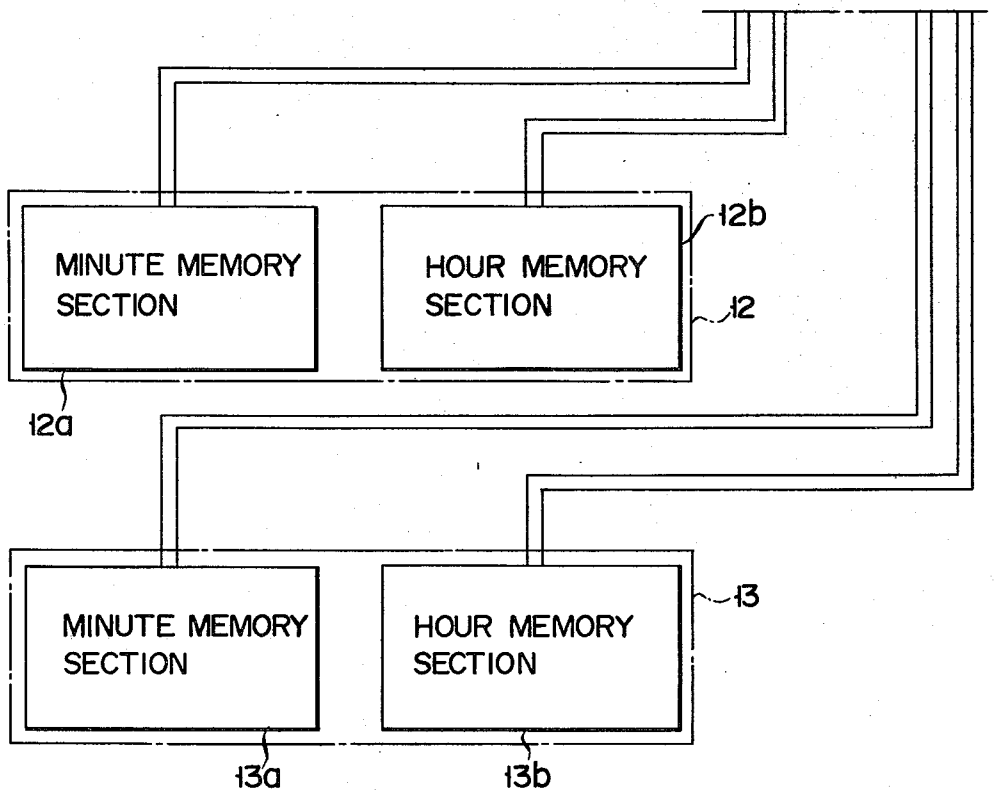

FIGS. 1A and 1B, which form an embodiment of the invention, show the circuit construction of an electronic timepiece having an alarm function and dynamic pattern display embodying the invention. In the Figures, designated at 1 is an oscillator for producing a reference frequency signal. The reference frequency signal is coupled to a frequency divider 2. The frequency divider 2 divides the reference frequency signal to produce a signal at a predetermined frequency and a one-second period signal. The predetermined frequency signal is supplied to a timing generator 3, and the one-second period signal is supplied to a 60-step second counter 4. The second counter 4 supplies a carry signal for every one minute to a 60-step minute counter 5. Minute count data obtained from the minute counter 5 is coupled to decoders 6 and 7 and also to coincidence circuits 8 and 9. The minute counter 5 supplies a carry signal for every one hour to a 60-step hour counter 10. Time data obtained from the hour counter 10 is coupled to the decoder 7 and also to the coincidence circuits 8 and 9. The decoder 6 decodes the minute count data from the minute counter 5 and produces output data $b_0$ to $b_{59}$ coupled to a display control circuit 11. The decoder 7 decodes the minute count data from the minute counter 5 and also the time data from the hour counter 10 and produces corresponding output data $a_0$ to $a_{59}$ coupled to the display control circuit 11. To the display control circuit 11 are supplied timing signals $f_1$, $f_2$ and $f_3$ of three different phases as display control signals from the timing signal generator 3 as will be described hereinafter in detail.

A minute memory section **12*a* and an hour memory section 12*b*, these sections constituting a first alarm time setting circuit 12, provide output data coupled to the coincidence circuit 7. Another minute memory section 13*a* and another hour memory section 13*b*, these sections constituting a second alarm time setting circuit, provide output data coupled to the coincidence circuit 8. The coincidence circuit 8 produces a coincidence signal $c_1$ supplied to the display control circuit 11 when the output data from the minute counter 5 and minute memory section 12*a* coincide and also the output data from the hour counter 10 and hour memory section 12*b* coincide. The coincidence circuit 9 produces a coincidence signal $c_2$ supplied to the display control circuit 11 when the output data from the minute counter 5 and minute memory section 13*a* coincide and also the output data from the hour counter 10 and hour memory section 13*b* coincide. The coincidence signals $c_1$ and $c_2$ are also supplied to an alarm sound control circuit 14. When either coincidence signal $c_1$ or $c_2$ is supplied to it, the alarm sound control circuit 14 produces a drive signal supplied to a buzzer unit 15, thus causing the unit 15** to produce an alarm sound.

Designated at 16 is an externally operable switch. By operating this switch 16, a one-shot pulse is produced from a one-shot circuit 17 to cause progressive shifting of the contents of a three-scale of counter 18 for display mode switching (i.e., count value "0" to "2"). A count "0" signal from the counter 18 is supplied as an ordinary time display command signal to the display control circuit 11, and count "1" and "2" signals from the counter are supplied as demonstration display command signals to the display control circuit 11. The display control circuit 11 provides liquid crystal drive signals which are coupled to a liquid crystal time display section 19 for optically displaying time data.

Figure 2:
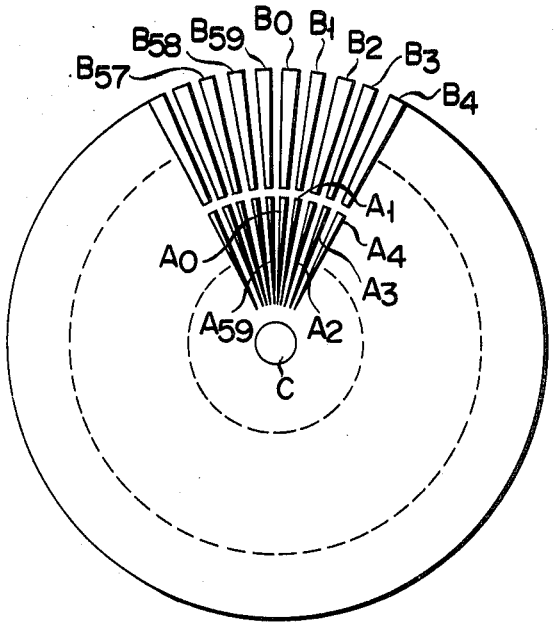
FIG. 2 is a view showing the arrangement of liquid crystal display electrodes constituting time display section 19.

FIG. 2 shows a liquid crystal electrode arrangement constituting the time display section 19. This liquid crystal electrode arrangement includes a circular center display element C, 60 inner bar display elements $A_0$ to $A_{59}$ provided around the center display element at uniform radial spacing and 60 outer bar display elements $B_0$ to $B_{59}$ each provided on the extension of each of the inner bar display elements $A_0$ to $A_{59}$.

Figure 3:
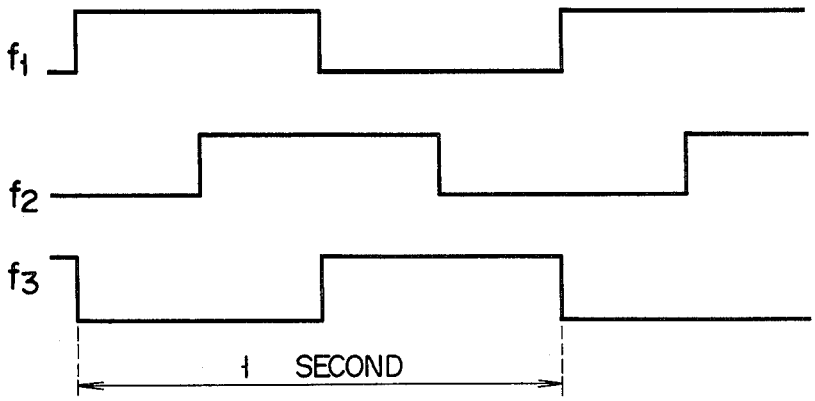
FIG. 3 is a waveform chart showing timing signals $f_1$, $f_2$ and $f_3$.

FIG. 3 is a waveform chart showing the aforementioned timing signals $f_1$, $f_2$ and $f_3$. These signals are one-second period signals with a duty ratio of ½. The timing signal $f_2$ is lagging behind the timing signal $f_1$ by 0.25 second, and he timing signal $f_3$ is lagging behind the timing signal $f_2$ also by 0.25 second.

Figure 4A:
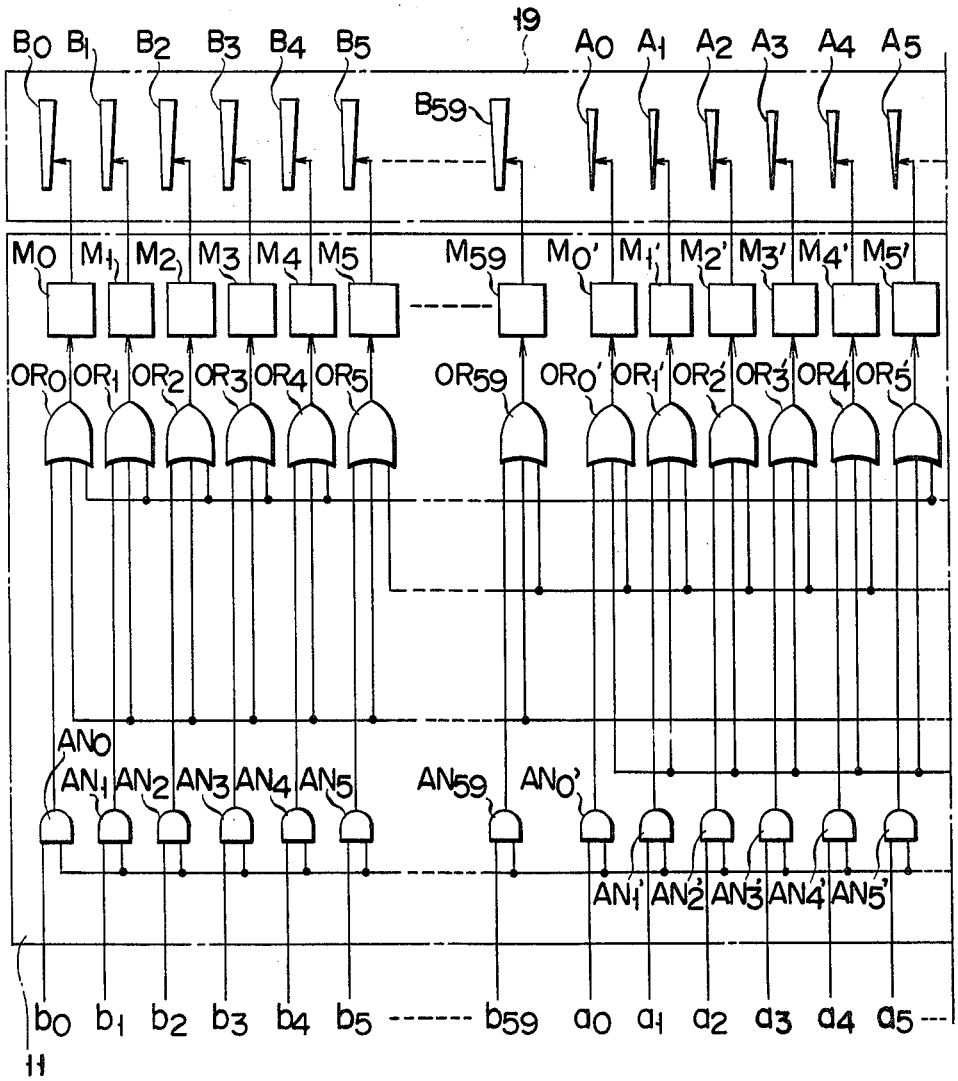
FIGS. 4A and 4B show a circuit diagram of a display control circuit and a time display section.
Figure 4B:
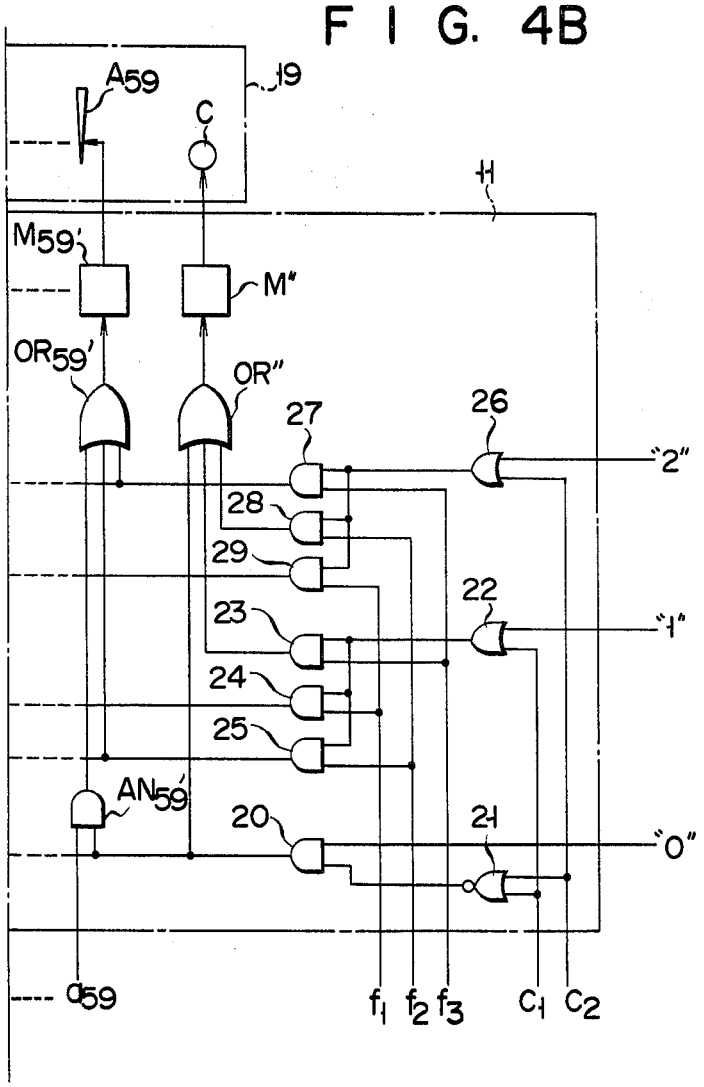

FIGS. 4A and 4B, which form FIG. 4, show the circuit diagram of the display control circuit 11 and time display section 19. The count "0" signal from the three-scale of counter 18 is coupled to one of two input terminals of an AND gate 20, and the output signal from a NOR gate 21 is coupled to the other input terminal of the AND gate 20. The coincidence signals $c_1$ and $c_2$ are coupled to respective input terminals of NOR gate 21. The count "1" signal from the counter 18 is coupled as a gate control signal through an OR gate 22 to one of input terminals of each of three AND gates 23, 24 and 25. The timing signals $f_1$ to $f_3$ are coupled to the other input terminals of the respective AND gates 23 to 25. The count "2" signal from the counter 18 is coupled as gating signal a through an OR gate 26 to one of input terminals of each of AND gates 27, 28 and 29. The timing signals $f_1$ to $f_3$ are coupled as gate control signals to the other input terminals of the respective AND gates 27 to 29. The output data $b_0$ to $b_{59}$ from the decoder 6 are each coupled to one of input terminals of a corresponding one of AND gates $AN_0$ to $AN_{59}$. The output of the AND gate 20 is coupled as a gating signal to the outer input terminals of the AND gates $AN_0$ to $AN_{59}$. The output data $a_0$ to $a_{59}$ from the decoder 7 are each coupled to one of input terminals of a corresponding one of AND gates $AN'_0$ to $AN'_{59}$. The output of the AND gate 20 is also coupled as a gating signal to the other input terminals of the AND gates $AN'_0$ to $AN'_{59}$. The output signals of the AND gates $AN_0$ to $AN_{59}$ are each coupled to one of input terminals of a corresponding one of OR gates $OR_0$ to $OR_{59}$, and the output signals of the AND gates $AN'_0$ to $AN'_{59}$ are each coupled to one of input terminals of a corresponding one of OR gates $OR'_0$ to $OR'_{59}$. The output signal of the AND gate 24 is coupled to an input terminal of each of the OR gates $OR_0$ to $OR_{59}$, and the output signal of the AND gate 25 is coupled to an input terminal of each of the OR gates $OR_0$ to $OR_{59}$. The output signal of the AND gate 27 is coupled to an input terminal of each of OR gates $OR_0$ to $OR_4$, $OR_{10}$ to $OR_{14}$, $OR_{20}$ to $OR_{24}$, $OR_{30}$ to $OR_{34}$, $OR_{40}$ to $OR_{44}$ and $OR_{50}$ to $OR_{54}$ and also to an input terminal of each of OR gates $OR'_5$ to $OR'_9$, $OR'_{15}$ to $OR'_{19}$, $OR'_{25}$ to $OR'_{29}$, $OR'_{35}$ to $OR'_{39}$, $OR'_{45}$ to $OR'_{49}$ and $OR'_{55}$ to $OR'_{59}$. The output signal of the AND gate 29 is coupled to an input terminal of each of the other OR gates than those to which the output signal of the AND gate 29 is coupled, namely the OR gates $OR_5$ to $OR_9$, . . . , $OR_{55}$ to $OR_{59}$ and $OR'_0$ to $OR'_4$, . . . , $OR'_{50}$ to $OR'_{54}$. The outputs of the AND gates 20, 23 and 28 are coupled to respective input terinals of an OR gate OR". The display control circuit 11 further includes liquid crystal drive circuits $M_0$ to $M_{59}$, $M'_0$ to $M'_{59}$ and M" respectively corresponding to the OR gates $OR_0$ to $OR_{59}$, $OR'_0$ to $OR'_{59}$ and OR". These liquid crystal drive circuits $M_0$ to $M_{59}$, $M'_0$ to $M'_{59}$and M" each produce a liquid crystal drive signal upon reception of an output signal from a corresponding OR gate. The liquid crystal drive signals produced from the liquid crystal drive circuits $M_0$ to $M_{59}$ are coupled to the respective outer display elements $B_0$ to $N_{59}$ in the time display section 19, those produced from the liquid crystal drive circuits $M'_0$ to $M'_{59}$ are coupled to the respective inner display elements $A_0$ to $A_{59}$, and that produced from the liquid crystal drive circuit M" is coupled to the center display element C.

Figure 5:
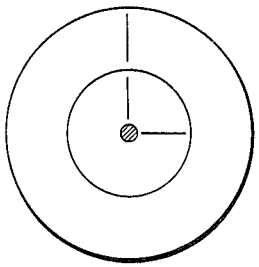
FIGS. 5, 6 and 7 are views showing the display in respective display modes.
Figure 6:
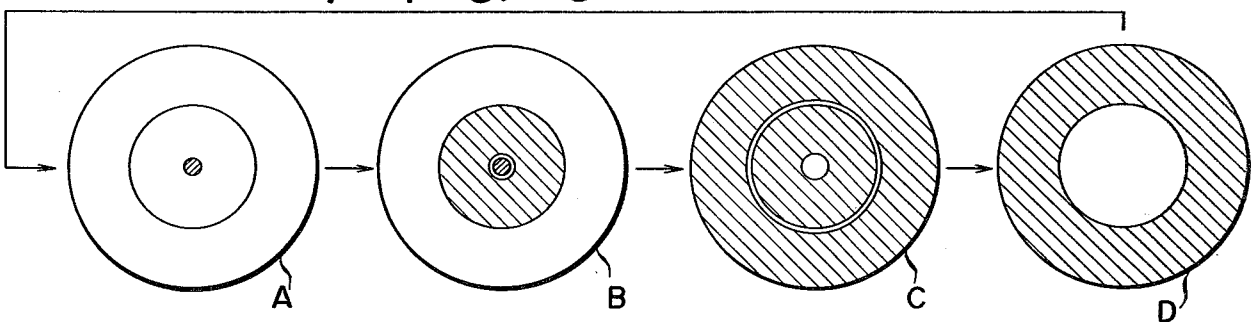
Figure 7:
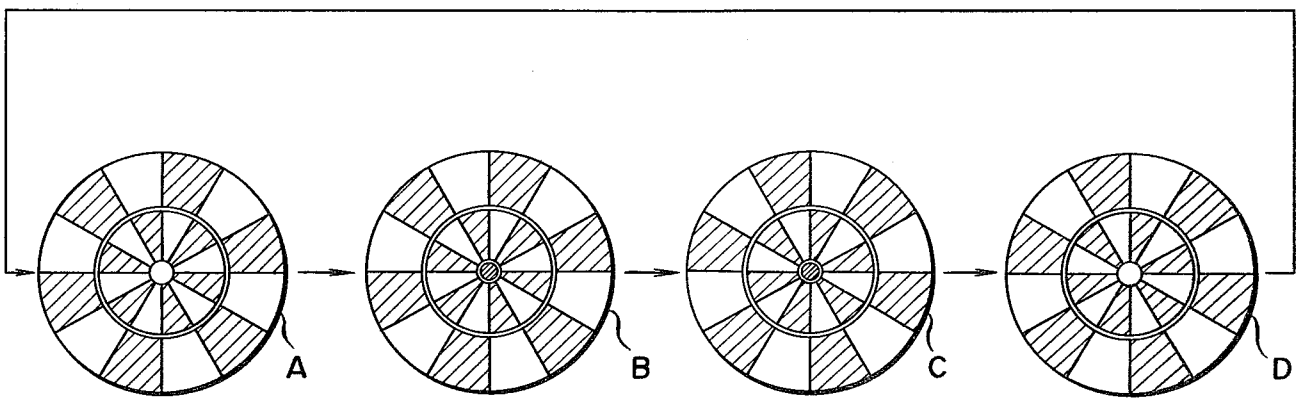

The operation of the electronic timepiece having the above construction will now be described with reference to FIGS. 5 to 7. When the contents of the counter 18 for display moder switching is "0" and also the coincidence signals $c_1$ and $c_2$ are not present, the AND gate 20 is receiving the count "0" signal from the counter 18 and the output signal of the NOR circuit 21 and is producing an output, so that the AND gates $AN_0$ to $AN_{59}$ and $AN'_0$ to $AN'_{59}$ are open. Thus, the output data $b_0$ to $b_{59}$ from the decoder 6 and output data $a_0$ to $a_{59}$ from the decoder 7 can be respectively supplied through OR gates $OR_0$ to $OR_{59}$ and $OR'_0$ to $OR'_{59}$ to the liquid crystal drive circuits $M_0$ to $M_{59}$ and $M'_0$ to $M'_{59}$. For example, when drive signals are supplied respectively from the liquid crystal drive circuits $M'_{15}$, $M_0$ and $M'_0$, the inner display elements $A_{15}$ and $A_0$ and outer display element $B_0$ are driven, and "3 o'clock flat" is displayed as pointer display of the present time as shown in FIG. 5.

When the coincidence circuit 8 detects the reaching of an alarm time set in the first alarm time setting circuit 12, it produces the coincidence signal $c_1$, which is coupled to the NOR gate 21 in the display control circuit 11 and is also coupled through the OR gates 22 to the AND gates 23, 24 and 25. As a result, the AND circuit 20 is closed, while the AND gates 23 to 25 are opened. Thus, the timing signals $f_1$ to $f_3$ are coupled through the respective AND gates 23 to 25. As shown in FIG. 3, for the first quarter of one second only the timing signal $f_1$ is supplied and coupled through the OR gate OR" to the liquid crystal drive circuit M". During this period, only the center display element C is thus driven for display as shown in FIG. 6A. For the second quarter of the second, the timing signal $f_2$ is supplied together with the timing signal $f_1$ as shown in FIG. 3.

During this period, the timing signal $f_1$ is continually coupled to the liquid crystal drive circuit M", while the timing signal $f_2$ is coupled through the OR gates $OR'_0$ to $OR'_{59}$ to the liquid crystal drive circuits $M'_0$ to $M'_{59}$. Thus, the inner display elements $A_0$ to $A_{59}$ as well as the center display element C are displayed as shown in FIG. 6B. For the third quarter of the second, the timing signal $f_3$ is supplied together with the timing signal $f_2$. During this period, the timing signal $f_2$ is continually coupled to the liquid crystal drive circuits $M'_0$ to $M'_{59}$, while the timing signal $f_3$ is coupled through the OR gates $OR_0$ to $OR_{59}$ to the liquid crystal display circuits $M_0$ to $M_{59}$. Thus, the inner display elements $A_0$ to $A_{59}$ and outer display elements $B_0$ to $B_{59}$ are displayed at the same time as shown in FIG. 6C. For the fourth quarter of the second, only the timing signal $f_3$ is supplied. Thus, during third period the outer display elements $B_0$ to $B_{59}$ in the time display section 19 are driven as shown in FIG. 6D. In the above way, the display pattern cycle, which changes for every quarter of one second, is repeated for every second, thus giving a dynamic impression like a skyrocket. This display permits the reaching of the first alarm time to be visually known. Meanwhile, with the appearance of the coincidence signal $c_1$ the alarm sound control circuit 14 causes the buzzer unit 15 to produce an alarm sound, thus permitting the reaching of the alarm time to be known by the sense of hearing.

When the coincidence circuit 8 detects the reaching of an alarm time set in the second alarm time setting circuit 12, it produces the coincidence signal $c_2$, which is coupled to the NOR gate 21 in the display control circuit 11 and is also coupled through the OR gate 26 to the AND gates 27 to 29. As a result, the AND gate 20 is closed, while the AND gates 27 to 29 are opened. Thus, the timing signals $f_1$ to $f_3$ are coupled through the respective AND gates 27 to 29. As shown in FIG. 3, for the first quarter of one second only the timing signal $f_1$ is supplied to the liquid crystal drive circuits $M_0$ to $M_4$, $M_{10}$ to $M_{14}$, . . . , $M_{50}$ to $M_{54}$ and $M'_5$ to $M'_9$, $M'_{15}$ to $M'_{19}$, . . . , $M'_{55}$ to $M'_{59}$. During this period, the inner display elements $A_5$ to $A_9$, $A_{15}$ to $A_{19}$, . . . , $A_{55}$ to $A_{59}$ and outer display elements $B_0$ to $B_4$, $B_{10}$ to $B_{14}$, . . . , $B_{50}$ to $B_{54}$ in the time display section 19 are driven as shown in FIG. 7A. For the second quarter of the second, the timing signal $f_2$ is supplied together with the timing signal $f_1$. The timing signal $f_2$ is coupled at this time through the OR gate OR" to the liquid crystal drive circuit M" to drive the center display element C. Thus, during third period a pattern, which is a combination of the display pattern as shown in FIG. 7A and a display pattern corresponding to the center display element C, is displayed as shown in FIG. 7B. For the third quarter of the second, the timing signal $f_3$ is supplied together with the timing signal $f_2$. The timing signal $f_3$ is coupled to the liquid crystal drive circuits $M_5$ to $M_9$, $M_{15}$ to $M_{19}$, . . . , $M_{55}$ to $M_{59}$ and $M'_0$ to $M'_4$, $M'_{10}$ to $M'_{14}$, ..., $M'_{50}$ to $M'_{59}$. Thus, during this period, the inner display elements $A_0$ to $A_4$, $A_{10}$ to $A_{14}$, . . . , $A_{50}$ to $A_{54}$ and outer display elements $B_5$ to $B_9$, $B_{15}$ to $B_{19}$, . . . , $B_{55}$to $B_{59}$ in the time display section 19 are driven to produce a display pattern as shown in FIG. 7C. For the fourth quarter of the second, only the timing signal $f_3$ is supplied. Thus, during the third period, a pattern, which is the same as the display pattern shown in FIG. 7 except that the display corresponding to the center display element C is absent, is displayed as shown in FIG. 7D. Since the display pattern which changes for every quarter of one second is repeated for every second in the above manner, it gives a dynamic impression of a continuously rotating pattern. It permits the reaching of the second alarm time to be visually known. Meanwhile, with the appearance of the coincidence signal $c_2$ the alarm sound control circuit 14 causes the buzzer 15 to produce an alarm sound, thus permitting the reaching of the alarm time to be known by the sense of hearing.

With the display as shown in FIGS. 6A to 6D provided at the time of the reaching of the first alarm time and the display as shown in FIGS. 7A to 7D provided at the time of the reaching of the second alarm time, it is possible readily to distinguish which one of the first and second alarm times the alarm sound is produced for.

When the contents of the counter 18 for switching display modes is changed to "1" by operating the external operation switch 16, in the display control circuit 11 the count "1" signal from the counter 18 is coupled through the OR gate 22 to the AND gates 23 to 25. Thus, the AND gates 23 to 25 are opened to pass the respective timing signals $f_1$ to $f_3$ like the case when the coincidence signal $c_1$ is supplied, so that a pattern as shown in FIGS. 6A to 6D is displayed in the time display section 19.

When the contents of the counter 18 is changed to "2" with the operation of the external operation switch 16, in the display control circuit 11 the count "2" signal from the counter 18 is coupled through the OR gate 26 to the AND gates 27 to 29. Thus, like the case when the coincidence signal $c_2$ is supplied, the timing signals $f_1$ to $f_3$ are passed through these AND gates, so that a pattern as shown in FIGS. 7A to 7D is displayed in the time display section 19.

In the above way, by operating the external operation switch 16 all the display elements $A_0$ to $A_{59}$, $B_0$ to $B_{95}$ and C in the time display section 19 can be driven to obtain displays as shown in FIGS. 6A to 6D and 7A to 7D. Thus, the electronic timepiece according to the invention can be used as an ornamental unit as well. Also, the displays as shown in FIGS. 6A to 6D and 7A to 7D, when provided in a shop, effectively attract attention of customers.

While in the above embodiment the time data is displayed in "hour" and "minute" units, it is possible to additionally display time data in "second" units. Also, it is possible to use multi-layer liquid crystal display cells such that an analog display section provided in one layer for optically displaying time data and a digital display section provided in another layer for displaying numerical values of alarm time, data, etc. can be switched one over to the other.

Further, while in the above embodiment two different pattern display modes are obtained independently of each other by operating the switch 16, it is possible to arrange that the pattern display mode is changed for, for instance, every ten seconds. Furthermore, while the above embodiment of the invention is directed to a timepiece having two alarm functions, it is also possible to provide other functions than the alarm function, for instance time a signaling function and a timer function and to provide different pattern display modes peculiar to the respective functions. In this case, the function that is in force can be visually known.

Further, while in the above embodiment liquid crystal has been used for the optical display means, it is also possible to use electroluminescent elements and also to effect color display. The display patterns are not limited to those in the above embodiment, and it is possible to provide various display patterns.

Further, while the above embodiment was directed to an electronic timepiece, the invention is also applicable to an electronic timepiece having computer functions.

What we claim is:

1. An electronic timepiece with dynamic pattern display comprising:

time counting means for dividing a reference clock signal and for providing time data;

display means coupled to said time counting means and having a plurality of optical display elements arranged in a geometric pattern for displaying time in an analog fashion, said displayed time being based on said time data from said time counting means;

alarm signal output means coupled to said time counting means for generating a first alarm signal when said time data from said time counting means reaches a predetermined first time and for generating a second alarm signal when said time data from said time data counting means reaches a predetermined second time;

sound producing means coupled to said alarm signal output means for producing an alarm sound in response to an output signal from said alarm signal output means; and display control means coupled to said display means and to said alarm signal output means, and which is responsive to said first alarm signal for causing said display means to produce an alarm display as a first dynamic pattern display mode which differs from a normal time display mode, said display control means being responsive to said second alarm signal from said alarm signal output means for causing said display means to produce an alarm display of a second dynamic pattern display mode which differs from said normal time display mode and which also differs from said first dynamic pattern display mode.

2. The electronic timepiece with dynamic pattern display of claim 1 wherein said display means comprises a first display element group which includes a plurality of display elements arranged in a ring shape; and a second display element group which includes a plurality of display elements are arranged externally and coaxially around said first display element group.

3. The electronic timepiece with dynamic pattern display of claim 2 wherein said first and second display elements groups each comprise sixty optical display elements.

4. The electronic timepiece with dynamic pattern display of claim 2 wherein said first dynamic pattern display mode comprises cyclically and selectively displaying said first and second display element groups by groups of display elements; and said second dynamic pattern display mode cyclically and selectively displaying the optical display elements of said first and second display element groups by each individual element.

5. The electronic timepiece with dynamic pattern display of claim 1 comprising memory means for storing data corresponding to at least one of said first time and second time.

6. The electronic timepiece with dynamic pattern display of claim 1 further comprising an external operation means coupled to said display control means for causing the displays of said first and second dynamic pattern display modes to be displayed at any time on said display means when said external operation means is actuated.

7. The electronic timepiece with dynamic pattern display of claim 6 wherein said external operation means includes a manually operable switch.

8. The electronic timepiece with dynamic pattern display of claim 1 wherein said display control means comprises means for generating a plurality of display control signals staggered in time with respect to each other so as to cause display of respective elements of said display means at different staggered times.

9. The electronic timepiece with dynamic pattern display of claim 2 wherein said display control means includes means for causing said display means to produce said first dynamic pattern display mode by displaying said first display element group for a first given period of time, displaying both said first and second display element groups for a second period of time subsequent to said first period of time, and displaying said second display element group and not said first display element group during a third period of time subsequent to said second period of time, and then cyclically repeating said displays.

10. The electronic timepiece with dynamic pattern display of claim 2 wherein said display control means comprises means for causing said display means to produce said second dynamic pattern display mode by causing respective pluralities of said display elements of said display elements of said respective display element groups to be displayed sequentially to thereby produce a pattern giving the appearance of rotation.

11. The electronic timepiece with dynamic pattern display of claim 9 wherein said first, second and third periods of time are sequential fractions of a second.

12. The electronic timepiece with dynamic pattern display of claim 1, comprising alarm time setting means for setting first and second alarm times which respectively correspond to said first and second times; and memory means coupled to said alarm time setting means for storing said first and second alarm times, said alarm time memory means being coupled to said alarm signal output means.

13. The electronic timepiece with dynamic pattern display of claim 2, wherein said display control means comprises means for generating a plurality of display control signals staggered in time with respect to each other so as to cause display of respective elements of said display means at different staggered times.

14. The electronic timepiece with dynamic pattern display of claim 9, wherein said display control means comprises means for causing said display means to produce said second dynamic pattern display mode by causing respective pluralities of said display elements of said display elements of said respective display element groups to be displayed sequentially to thereby produce a pattern giving the appearance of rotation.

* * * * *

UNITED STATES PATENT AND TRADEMARK OFFICE

CERTIFICATE OF CORRECTION

PATENT NO. : 4,421,419

DATED : December 20, 1983

INVENTOR(S) : Morio MORISHIGE, et al

It is certified that error appears in the above-identified patent and that said Letters Patent is hereby corrected as shown below:

On the initial page of the patent, In the Title, change the title to: --ELECTRONIC TIMEPIECE WITH DYNAMIC PATTERN DISPLAY--;

COLUMN 3, line 36, change "as gating signal a" to --as a gating signal--.

Signed and Sealed this

*Thirty-first* Day of *July 1984*

[SEAL]

*Attest:*

GERALD J. MOSSINGHOFF

*Attesting Officer*

*Commissioner of Patents and Trademarks*